US011351660B2

(12) United States Patent
Bingham

(10) Patent No.: US 11,351,660 B2
(45) Date of Patent: Jun. 7, 2022

(54) REVERSIBLE RATCHET WRENCH

(71) Applicant: Mark Bingham, Maple Grove, MN (US)

(72) Inventor: Mark Bingham, Maple Grove, MN (US)

( * ) Notice: Subject to any disclaimer, the term of this patent is extended or adjusted under 35 U.S.C. 154(b) by 286 days.

(21) Appl. No.: 16/508,802

(22) Filed: Jul. 11, 2019

(65) Prior Publication Data

US 2020/0016727 A1 Jan. 16, 2020

Related U.S. Application Data

(60) Provisional application No. 62/697,142, filed on Jul. 12, 2018.

(51) Int. Cl.
*B25B 13/46* (2006.01)
*B25B 23/00* (2006.01)

(52) U.S. Cl.
CPC ..... *B25B 13/463* (2013.01); *B25B 23/0007* (2013.01)

(58) Field of Classification Search
CPC ..... B25B 23/0007; B25B 13/463
USPC ..... 81/58.5, 60–63.2
See application file for complete search history.

(56) References Cited

U.S. PATENT DOCUMENTS 978,395 A * 12/1910 Peters ..... B25B 13/463 81/58.5
1,019,825 A 3/1912 Mossberg
2,235,434 A 3/1941 Kincaid
2,331,339 A * 10/1943 Morris ..... B25B 13/462 192/45.1
3,255,647 A 6/1966 Gray
3,958,470 A 5/1976 Lee
4,254,675 A 3/1981 Marlow et al.
(Continued)

FOREIGN PATENT DOCUMENTS

CN 301921196 5/2012
FR 1191282 10/1959
(Continued)

OTHER PUBLICATIONS

Dewalt, Ratchet, Quick Release, SAE, 3/8-Inch Drive, Date first available Jun. 19, 2019, [online] retrieved Jun. 29, 2020, available from internet, www.amazon.com (Year: 2019).
(Continued)

*Primary Examiner* — Hadi Shakeri
(74) *Attorney, Agent, or Firm* — Dicke, Billig & Czaja, PLLC

(57) ABSTRACT

A reversible ratchet wrench includes a moveable pawl connected to a handle via a linkage such that the pawl cannot become disengaged from the hand during operation of the wrench. The handle is pivotally attached to housing forming a portion of a head of the wrench, where pivoting of the handle between a first position and a second position switches a position of a pawl between a first position and a second position to thereby change an operating direction of the wrench. A distance of movement of a proximal end of the handle, opposite a head of the wrench, during switching is confined to a limited range by elongating the wrench head and extending a distance between a connection point of the handle to the pawl and the pivotal connection of the handle to the housing.

19 Claims, 9 Drawing Sheets

(56) References Cited

U.S. PATENT DOCUMENTS

| | | | | |
|---|---|---|---|---|
| 6,776,071 | B1 * | 8/2004 | Chen | B25B 13/461 81/58 |
| 6,978,699 | B2 | 12/2005 | Yuan-Chin et al. | |
| 7,062,994 | B2 * | 6/2006 | Chen | B25B 13/463 81/62 |
| 7,197,964 | B2 | 4/2007 | Buchanan | |
| 7,587,961 | B1 | 9/2009 | Chiang | |
| D613,568 | S | 4/2010 | Yu | |
| 7,765,896 | B1 | 8/2010 | Chen | |
| D665,239 | S | 8/2012 | Tillet | |
| 8,245,602 | B2 | 8/2012 | Chan | |
| D666,466 | S | 9/2012 | Gresham et al. | |
| 8,616,095 | B2 | 12/2013 | Chi | |
| D722,847 | S | 2/2015 | Lin | |
| D729,024 | S | 5/2015 | Lin | |
| D753,970 | S | 4/2016 | Ou | |
| D755,594 | S | 5/2016 | Ou | |
| 9,975,222 | B2 | 5/2018 | Yang | |
| D876,198 | S | 2/2020 | Chen | |
| 2003/0221521 | A1 | 12/2003 | Shu-Ying et al. | |
| 2005/0268751 | A1 | 12/2005 | Buchanan | |
| 2008/0156151 | A1 | 7/2008 | Chen | |
| 2016/0214241 | A1 | 7/2016 | Kao | |

FOREIGN PATENT DOCUMENTS

| | | |
|---|---|---|
| GB | 2538744 | 11/2016 |
| WO | D063388-001 | 4/2013 |

OTHER PUBLICATIONS

SATA, 3-Piece 1/4-lnch, 3/8-lnch and 1/2-Inch Drive 120P Professional Ratchet Set with On/Off Switch, Date first available Jun. 3, 2019, [online]retrieved Jun. 29, 2020, available from internet, www.amazon.com (Year: 2019).

Gearwrench, 1/2" Drive 84 Tooth Long Handle Dual Material Teardrop Ratchet, Date first available Jul. 22, 2013, [online] retrieved Jun. 29, 2020, available from internet, www.amazon.com (Year: 2013).

Williams, S-52EHLA Long Enclosed Head,Date first available Mar. 26, 2014, [online]retrieved Jun. 29, 2020, available from internet, www.amazon.com (Year: 2014).

* cited by examiner

REVERSIBLE RATCHET WRENCH

CROSS-REFERENCE TO RELATED APPLICATIONS

This application claims priority under 35 U.S.C. 119(e) to U.S. Provisional Patent Application Ser. No. 62/697,142 filed Jul. 12, 2018, and incorporated herein by reference.

BACKGROUND

Ratchet wrenches are used in a wide variety of applications to tighten and loosen fasteners, such as nuts and bolts, for example. Ratchet wrenches typically include a switching mechanism that can be operated to selectively change the ratcheting direction of the wrench, so that the wrench can be operated in a forward direction or a reverse direction to tighten and loosen fasteners. Such wrenches are sometimes referred to as reversible ratchet wrenches.

DETAILED DESCRIPTION

Figure 1A:
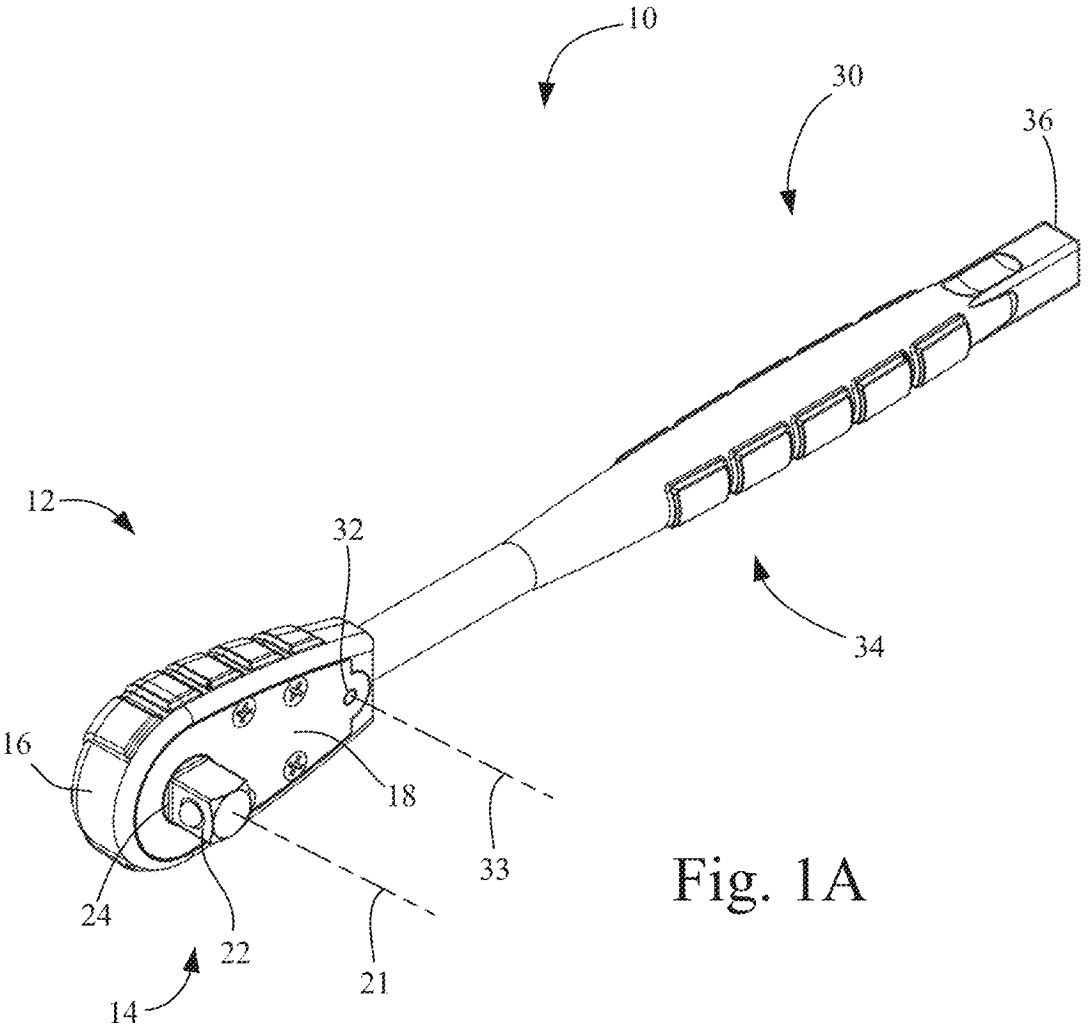
FIG. 1A is a perspective view illustrating a reversible ratchet, according to one example.
Figure 1B:
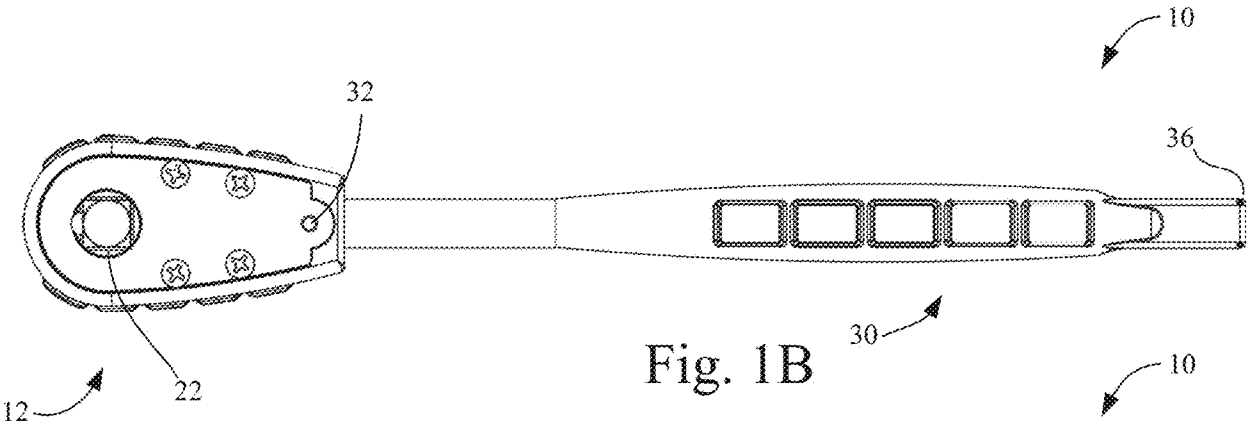
FIG. 1B is a bottom view illustrating a reversible ratchet, according to one example.
Figure 1C:
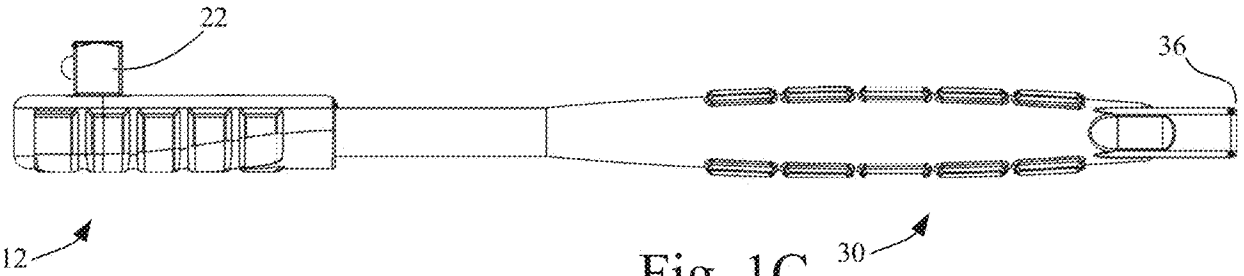
FIG. 1C is a side view illustrating a reversible ratchet, according to one example.
Figure 1D:
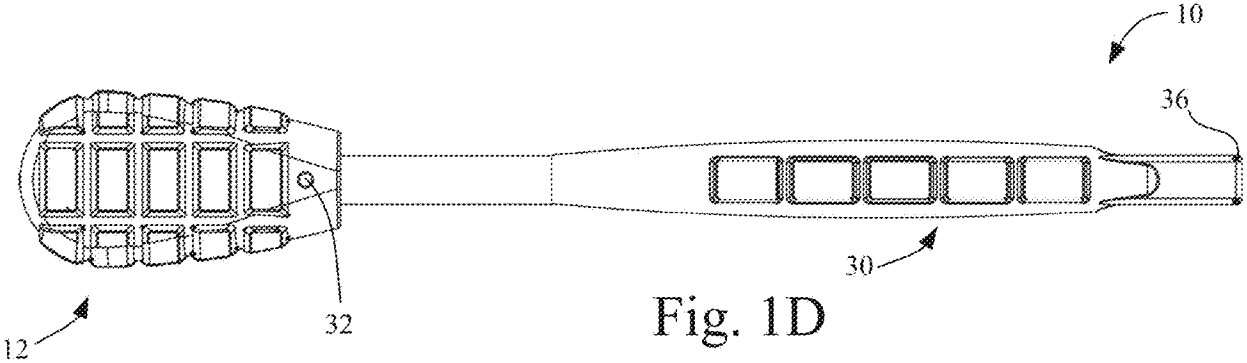
FIG. 1D is a top view illustrating a reversible ratchet, according to one example.

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Reversible ratchet wrenches, such as a socket wrenches, are used to tighten and loosen any number of fastener types, including nuts and bolts, for example. Ratchets typically include a handle which contiguously extends from a head of the ratchet, with the ratchet head including a ratcheting mechanism disposed therein. Such ratcheting mechanisms typically include a drive gear configured to engage a fastener which is to be tightened or loosened, and a pawl to control a rotational direction of the drive gear. In one example, a drive gear may include an axially disposed mounting stud to which different sized sockets may be attached for engaging different sizes and types of nuts and bolts. Drive gears typically include a number of circumferentially disposed gear teeth, with corresponding teeth on the pawl to engage the gear teeth to prevent rotation of the drive gear in a selected direction. Typically, the pawl is moveable between a first and second position (e.g., a forward position and a reverse position), with the pawl preventing rotation of the ratchet wheel in one direction (e.g., a forward direction) when in the first position, and preventing rotation of the drive gear in the other direction (e.g., a reverse direction) when in the second position, while allowing free rotation of the drive gear in the opposite direction when in either position.

In one example, when in the first position, the pawl prevents rotation of the drive gear in a forward direction about the drive gear axis relative to the head, such that upon application of torque to the head in the forward direction via the handle, the drive gear and socket attached thereto rotate together with the head in the forward direction to tighten a fastener (e.g., a nut or bolt). Upon application of torque to the head in the reverse direction via the handle, the pawl allows the drive gear to rotate freely about the drive gear axis relative to the head, thereby enabling the handle and head to be "ratcheted" in the reverse direction for another turn without loosening the fastener.

Conversely, when in the second position, the pawl prevents rotation of the drive gear in a reverse direction about the drive gear axis relative to the head, such that upon application of torque to the head in the reverse direction via the handle, the drive gear and socket attached thereto rotate together with the head in the reverse direction together with the head to loosen the fastener (e.g., a nut or bot). Upon application of torque to the head in the reverse direction via the handle, the pawl allows the drive gear to rotate freely about the drive gear axis relative to the head, thereby by enabling the handle and head to be "ratcheted" in the reverse direction for another turn without tightening the fastener. The above described forward and reverse ratcheting action enables a fastener to be tightened or loosened in small increments without disconnecting the wrench from the fastener.

Typically, reversible ratchet wrenches include a selector external to a head of the wrench that is actuated to move the pawl between the first and second positions to control the ratcheting direction (e.g., tightening or loosening). While an external selector is effective at controlling the direction of a reversible ratchet wrench, it may be inconvenient to actuate the selector when the wrench used in a confined space, such as within a vehicle engine compartment, for example. In such cases, it may be necessary to disengage the wrench from a fastener and withdraw the wrench from the engine compartment in order to operate the switch to change the operating direction of the wrench.

Some reversible ratchet wrenches have been developed which eliminate an external selector and employ a handle that is pivotally coupled to the ratchet head, where pivoting of the handle relative to the head operates a switching mechanism to control the operating direction of the wrench. However, to switch between ratcheting directions, a proximal end of the handle (opposite the head) may pivot over a wide range which may make switching the ratchet difficult when being used in confined spaces. Additionally, an amount of torque which must be applied to the handle to operate the switching mechanism may be small enough that unintended switching of the direction may occur through inadvertent rotation of the handle while tightening or loosening a fastener. Also, where such wrenches employ a pawl, the pawl can potentially become disengaged from the switching mechanism and be unable to prevent movement of the drive gear in either direction.

As described herein, the present disclosure provides a reversible ratchet wrench that employs a handle that is pivotally attached to a head of the wrench, where pivoting of the handle about a pivot point switches a position of a pawl between a first position and a second position to change an operating direction of the wrench (or ratcheting direction), where a distance of movement of a proximal end of the handle is limited to a relatively confined range (e.g., to not more than one inch) by employing a greater than conventional distance between a connection point of the handle to the pawl and the pivotal connection of the handle to the housing (sometimes referred to herein a fulcrum distance). While such distance may elongate the ratchet head relative to conventional wrenches, a pivoting range of the handle is maintained within a relatively limited range so that the operating direction of the wrench can be switched in confined spaces. Additionally, according to examples described herein, the pawl is connected to the handle such that the pawl cannot become disengaged from the handle during operation of the wrench.

FIGS. 1A to 1D respectively illustrate perspective, bottom, side, and top views of a reversible ratchet wrench 10, according to one example of the present disclosure. Wrench 10 includes a head 12 having a housing 14 including with a housing base 16 and a housing cover 18. As will be illustrated in greater detail below, housing 14 forms a compartment to hold a drive gear 20 (see FIG. 2) having a mounting stud 22 extending from housing 14 via a drive opening 24 in cover 18, where various attachments, such as sockets, for example, may be attached to mounting stud 22 for engaging any number of fasteners (e.g., nuts, bolts, etc.). Mounting stud 22 defines a drive axis 21 about which wrench 10 is rotated to tighten or loosen such fasteners.

A handle 30 extends into housing 14 and is coupled to housing 14 via a pin 32 defining a pivot axis 33 about which handle 30 can pivot, where pivot axis 33 is parallel to drive axis 21. As will be described in greater detail below, according to one example, handle 30 is able to pivot in opposite directions about pin 32 between a first position and a second position to change a ratcheting direction of wrench 10. In one example, handle 30 includes a first portion or fulcrum portion 38 (see FIG. 2) extending within housing 14 from pin 32 to a distal end, and a second portion or grip portion 34 extending from pin 32 to a proximal end 36. In one example, proximal end 36, which is opposite head 12, is square in cross-section in order to receive a driver extension (not illustrated) to enable greater torque to be applied to wrench 10.

Figure 2:
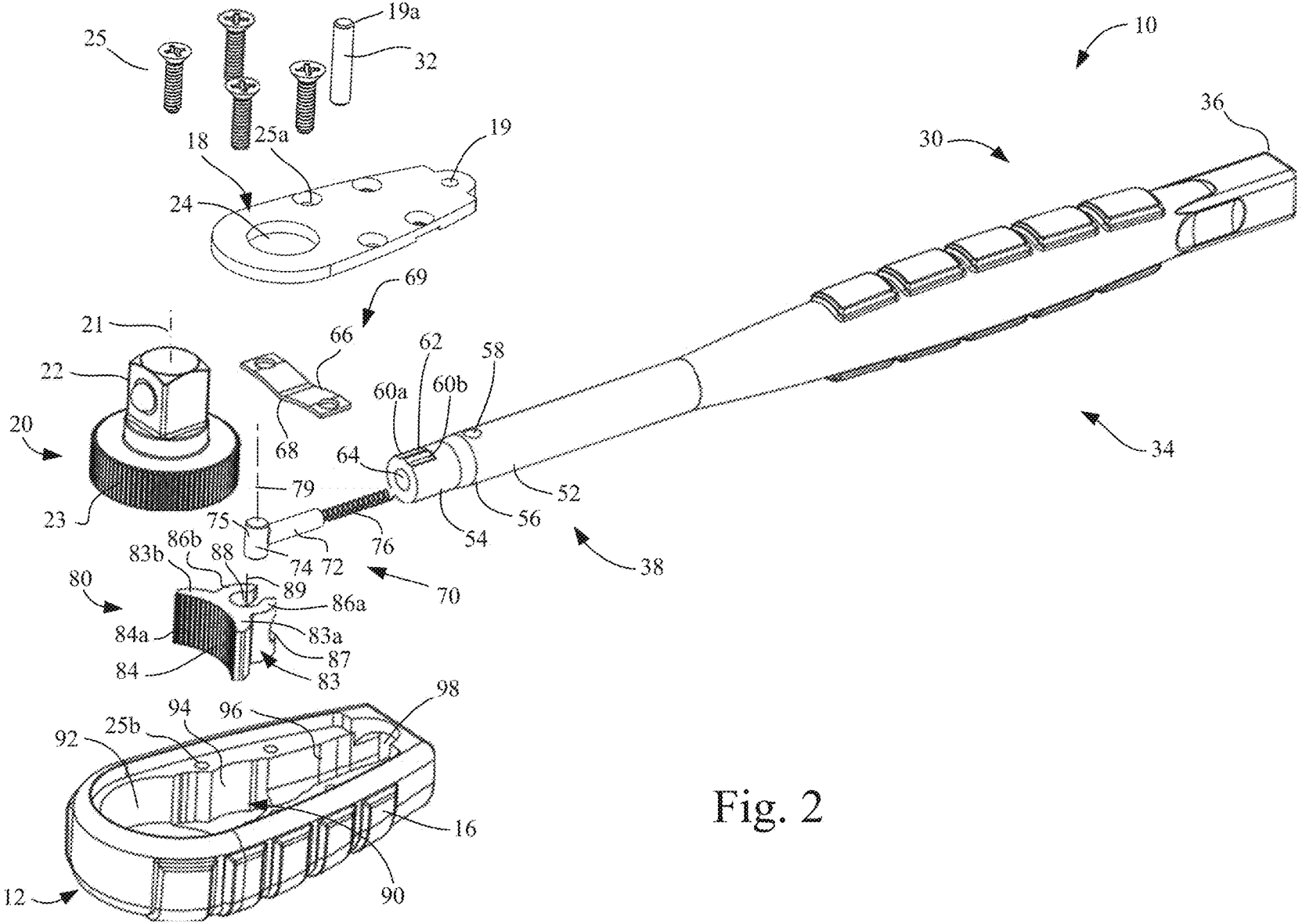
FIG. 2 is an exploded view illustrating a reversible ratchet, according to one example.

FIG. 2 is an exploded view illustrating an example of wrench 10. In addition to axially extending mounting stud 22, drive gear 20 is generally cylindrical and includes a plurality of gear teeth 23 arrayed about an external cylindrical surface of drive gear 20. In one example, housing cover 18 includes a plurality of screws 25 (or other suitable fasteners) to secure housing cover 18 to housing base 16 via through-holes 25*a* in housing cover 18 and corresponding threaded openings 25*b* in housing base 16. In one example, housing cover 18 includes a pin opening 19 to receive a tapered or shoulder region 19*a* of pin 32.

As shown in FIG. 2, in one example, a fulcrum portion 38 of handle 10 includes a first portion 52 having a first diameter, and a second portion 54 having a second diameter smaller than the first diameter of first portion 52 and which extends to a distal end of handle 10, and a tapered region 56 therebetween. In one example, first portion 52 includes a pin bore 58 transversely extending there through to receive pin 32, where, as will be described in greater detail below, pin 32 pivotally couples handle 30 to head 14 of wrench 10. As will be described in greater detail below, handle 30 is pivotable about pin 32 between a first position and a second position to select an operational or ratcheting direction of wrench 10 (e.g., a forward/tightening direction and a reverse/loosening direction).

In one example, as illustrated, second portion 54 of fulcrum portion 38 of handle 10 includes a pair of side-by-side grooves, 60*a* and 60*b* axially extending along second portion 54 and which are separated by a ridge 62, and an axially extending bore 64 at a free end of second portion 54 which is generally concentric with the outer surface of second portion 54. In one example, as will be described in greater detail below, wrench 20 further includes a spring 66, such as a leaf spring, for example, which has two angled legs which meet to form an apex 68, where ridge 62, and apex 68 of spring 66 together serve as a position latch 69 to maintain handle 30 in a selected one of a first and a second position (e.g., a forward and a reverse position) to which handle 30 has been pivoted.

According to one example, a linkage 70 couples a distal end 71 of fulcrum portion 38 of handle 30 to a pawl 80 (which is described in greater detail below). In one example, linkage 70 includes first linkage portion, such as a linkage shaft 72, and a second linkage portion, such as a linkage head 74, and a biasing means, such as, for example, a spring 76. Any number of other biasing means may be employed, such as a compressible elastic material and compressed air (e.g., an air bladder), for example. In one example, linkage 70 comprises an extension of handle 30, with linkage head 74 defining a distal end extension 75 of handle 30 and having a distal axis 79 which is transverse to bore 64 (and to the longitudinal axis of handle 30) and parallel with drive axis 21. In one example, linkage head 74 is cylindrical in shape, such that linkage 70 may sometimes be referred to as a pin or linkage pin. In another example, linkage head 74 may be spherical in shape (e.g.; such as a ball of a ball-and-socket type connection). In one example, linkage shaft 72 includes an internal bore (not illustrated) to receive one end of spring 76, with axially bore 64 of second portion 54 to receive linkage shaft 72 and the other end of spring 76.

In one example, wrench 20 includes a pawl 80. In one case, pawl 80 includes a half-moon shaped or arcuate body 82 having a first side 84 having a concave front surface 84*a* facing drive gear 20 and having a plurality of pawl teeth 84*b* disposed thereon, and an opposing second side 83 having convex portions such that concave front surface 84 and convex portions of rear side 83 together define first and second tapered ends 83*a* and 83*b*. In one example, pawl 80 includes a cavity 88 having a circular cross-section which is disposed between first and second ends 83*a* and 83*b*, and which is configured to receive linkage head 74 of linkage 70. In one example, as illustrated, finger-like extensions 86*a* and 86*a* extend from rear surface 83 to form a generally cylindrical cavity 88 having an cavity axis 89 which is generally parallel to drive axis 21.

According one example, as illustrated, cavity 88 comprises a cylindrical opening having an interior surface which encompasses greater than 180-degrees of cylindrically-shaped linkage head 74 which is axially received within cavity 88, such that linkage head 74 is retained within cavity 88 and pawl 80 cannot be separated from linkage 70 in a direction transverse to distal axis 79. In other examples, cavity 88 may encompass less than 180 degrees of linkage head 74 while still retaining linkage head 74 during operation. As described in greater detail below, with housing cover 18 secured to housing base 16, housing cover 18 prevents pawl 80 from being separated from linkage 70 in the direction of distal axis 79 such that pawl 80 cannot be separated from linkage 70.

Although illustrated as being a cylindrical opening and cylindrically shaped pin, cavity 88 and linkage head 74 can be of other shapes having circular cross-sections that provide a pivotal connection between linkage 70 and pawl 80, such as a ball-and-socket type connection, for example, where cavity 88 comprises a socket and linkage head 74 comprises a ball. In other examples, it is noted that linkage head 74 may include a cavity to receive a male connector disposed on the second side 83 of pawl 80.

Figure 3:
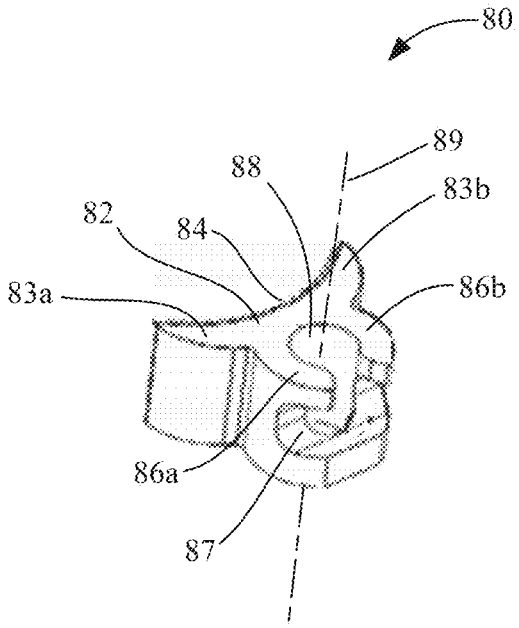
FIG. 3 is a perspective view illustrating a pawl of a reversible ratchet, according to one example.

FIG. 3 is a perspective view of pawl 80, according to one example. As illustrated, a horizontal cutout 87 extends transversely to cavity axis 89 through fingers 86*a* and 86*b* to enable a range of rotation of pawl 80 about linkage head 74 when handle 30 and pawl 80 are moved between the first and second positions, which will be described in greater detail below.

As shown in FIG. 2, in one example, housing base 16 forms an internal compartment 90 including a drive gear compartment 92 to receive drive gear 20, a pawl compartment 94 to receive pawl 80, and a fulcrum compartment 96 to receive fulcrum portion 38 of handle 10 via a housing opening 98.

Figure 4:
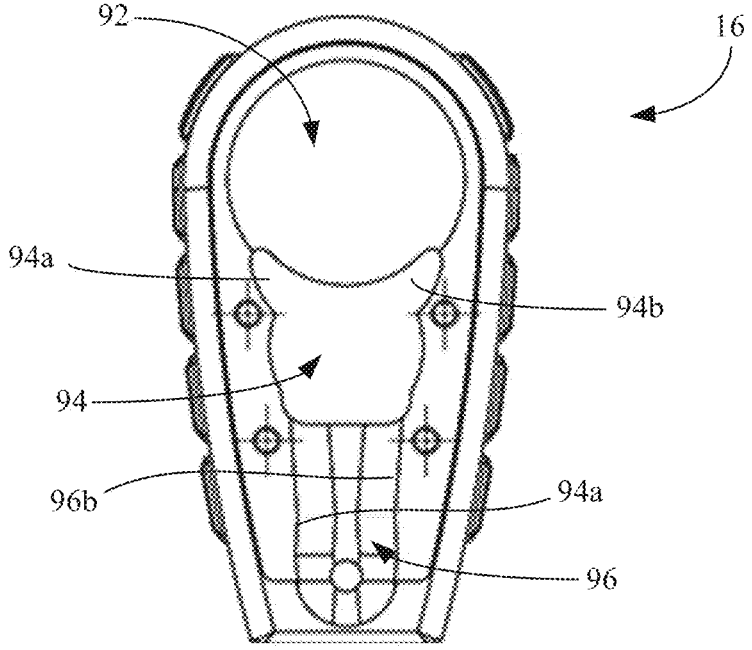
FIG. 4 is a top view of a portion of a housing of a reversible ratchet, according to one example.

FIG. 4 is a top view illustrating housing base 16 of FIG. 2. As illustrated, pawl compartment 94 includes a pair of pawl guide regions 94*a* and 94*b* having arcuate sidewall surfaces which, as will be described in greater detail below, are respectively configured to guide first and second ends 83*a* and 83*b* of pawl 80 toward drive gear 20 when pawl 80 is moved between the first and second positions. In one example, first and second tapered ends 83*a* and 83*b* of pawl 80 are slightly narrower than dimensions of pawl guide regions 94*a* and 94*b* to enable the first and second ends 83*a* and 83*b* to be drawn into and wedged between drive gear 20 and housing base 16 when pawl 80 engages drive gear 20 so that pawl teeth 84*a* and drive teeth 23 do not slip during operation of wrench 10.

In one example, opposing sidewalls 96*a* and 96*b* of fulcrum compartment 96 are contoured to match the outer contour of the first or fulcrum portion 38 of handle 30. As will be described in greater detail below, when handle 30 is in the first or second position, portions of fulcrum portion 38 radially opposite to one another relative to pin 74 engage opposing sidewalls 96*a* and 96*b* such that when torque is applied to handle 30 to tighten or loosen a fastener, the torque is applied to head 12 via housing base 16 and not applied to linkage 70.

Figure 5:
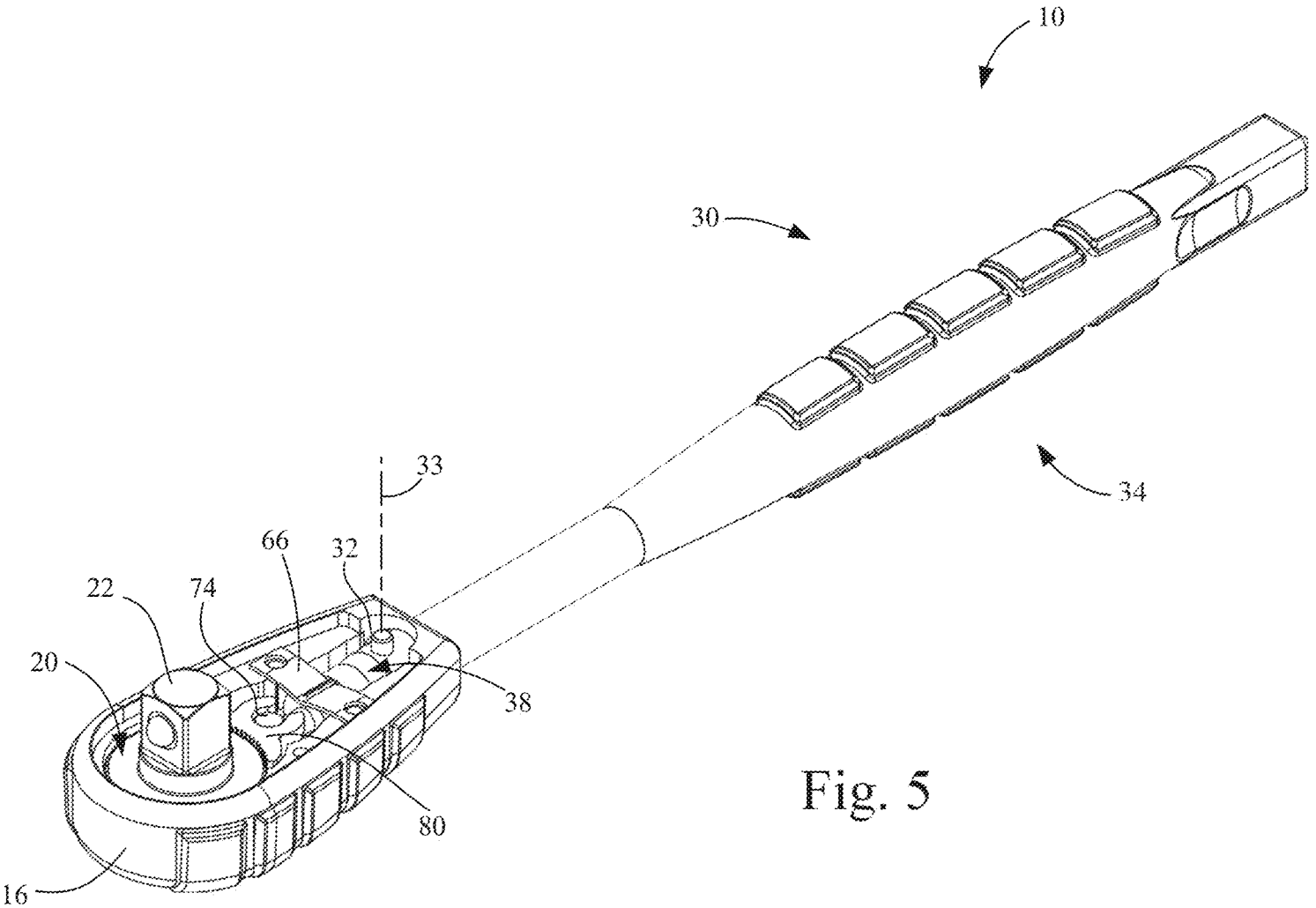
FIG. 5 is a perspective view illustrating components of a head of a reversible ratchet, according to one example.

FIG. 5 is a perspective view illustrating wrench 20 of FIG. 2 in an assembled configuration with housing cover 18 removed. As illustrated, spring 66 of position latch 69 is biased toward fulcrum portion 38 (downward in FIG. 5) so that apex 68 is positioned adjacent to ridge 62 and engages one of the selector grooves 60*a* and 60*b*, as illustrated in greater detail below by FIGS. 7A and 7B. As described below by FIGS. 6A and 6B, handle 30 is selectively pivotable between first and second positions (via rotation about pivot axis 33 of pin 32) to change an operating direction (e.g., forward and reverse) of wrench 10, where position latch 69 maintains handle 30 in the selected operating position.

Figure 6B:
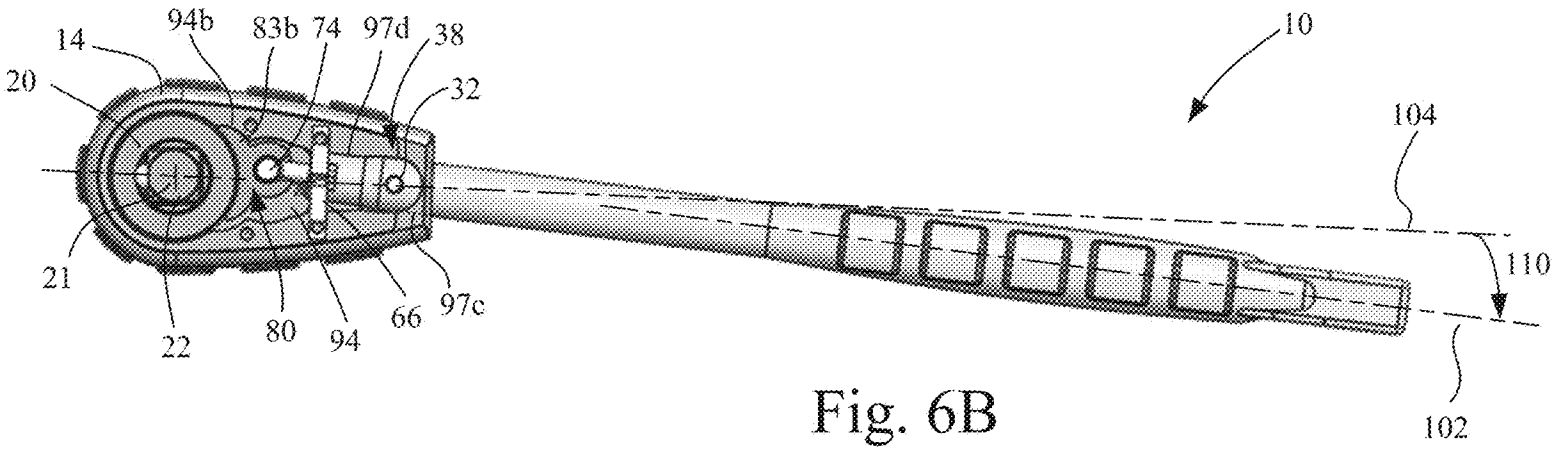
FIG. 6B is a top view illustrating a reversible ratchet in a second position, according to one example.
Figure 6A:
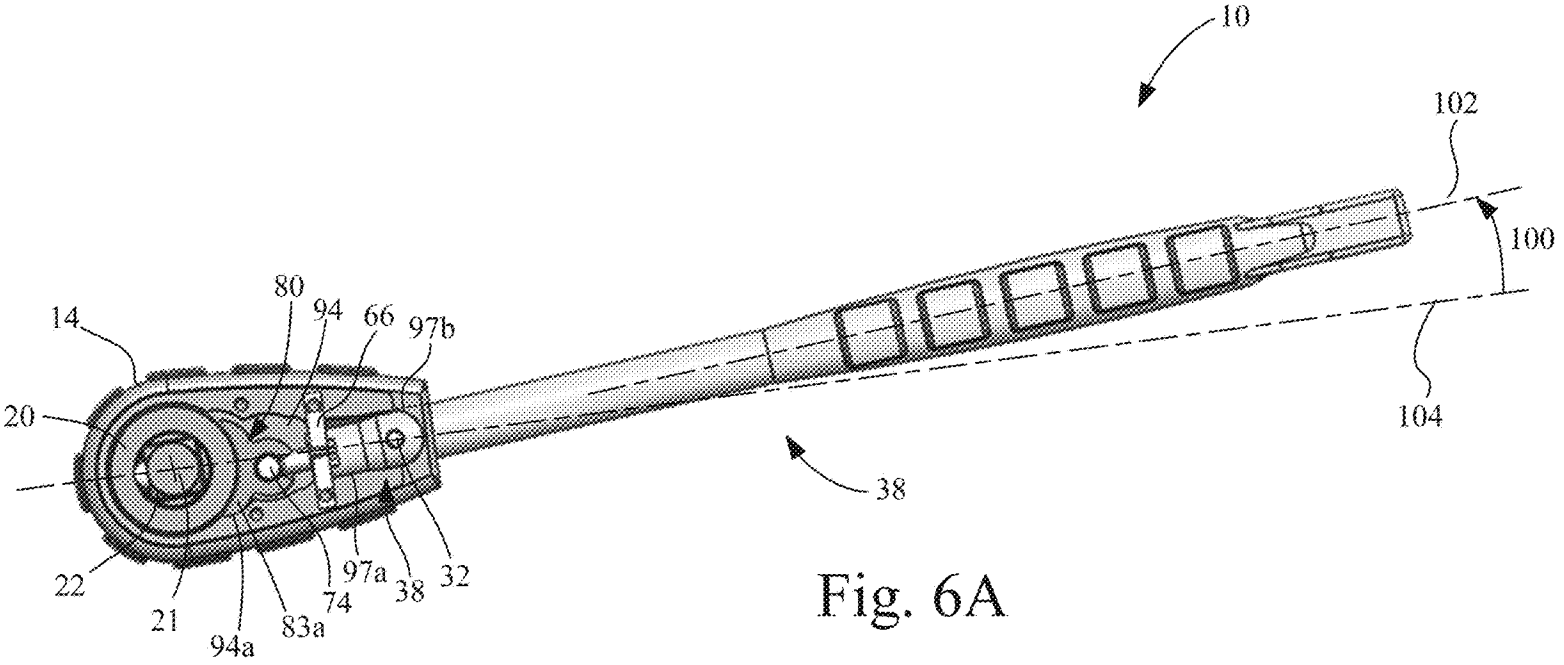
FIG. 6A is a top view illustrating a reversible ratchet in a first position, according to one example.

FIGS. 6A and 6B illustrate an operation of reversible ratchet wrench 10, according to one example. FIG. 6A is a bottom view of wrench 10 (with cover 18 removed), where linkage shaft 72 and linkage spring 76 are disposed within internal shaft 64 of handle 30, and linkage head 74 is disposed within pawl cavity 88, such that distal axis 79 of linkage head 74 is coaxially aligned with the cavity axis 89 of pawl cavity 88. When disposed within internal shaft 64, linkage spring 76 is compressed such that linkage 70 biases pawl 80 against drive gear 20. With linkage head 74 retained within pawl cavity 88 and linkage shaft 72 disposed within internal shaft 64 such that pawl 80 is biased against drive gear 20, upon securing housing cover 18 to housing base 16, pawl 80 is retained by and cannot become disengaged from handle 30 during operation of wrench 10.

FIG. 6A illustrates wrench 10 in a first or tightening position, where handle 30 is pivoted about pin 32 to a first position from a centerline 104 of wrench 10, such that a centerline 102 of handle 30 is rotated from centerline 104 of wrench 104 as indicated by directional arrow 100. It is noted that centerline 102 of handle 30 is a line extending through distal axis 79 of linkage head 74 and pivot axis 33 of pin 32, while wrench centerline 104 is a line extending though drive axis 21 of drive gear 20 and pivot axis 33 of pin 32.

As illustrated by FIG. 6A, with wrench 10 in the first or tightening position, pawl 80 is in a "forward" position with tapered portion 83*a* being positioned within pawl guide region 94*a*. When rotational torque is applied to grip portion 34 of handle 30 in direction 100 about drive axis 21 (i.e., a forward or tightening direction), fulcrum portion 38 of handle 30 contacts portions of opposing sidewalls 96*a* and 96*b* of fulcrum compartment 96 (such as portions 97*a* and 97*b*) to rotate housing 14 and handle 30 about drive axis 21 in forward direction 100. As housing 14 and handle 30 are rotated in forward direction 100, with mounting stud 22 being held stationary (such as when engaged with a fastener, for example), drive gear 20 attempts to rotate in reverse direction 110 (i.e., opposite to forward direction 100) relative to housing 14.

However, as drive gear 20 attempts to rotate, pawl teeth 84*a* engage circumferential gear teeth 23 and tapered portion 83*a* is drawn and wedged into pawl guide region 94*a*, thereby preventing rotation of drive gear 80 relative to housing 14 in direction 110 (opposite to direction 100). As a result, drive gear 20, including mounting stud 22, are rotated together with housing 14 and handle 30 in direction 100 (forward direction) about drive axis 21. When torque is applied to handle 30 about drive axis 21 in a direction 110 (reverse direction), pawl 80 allows drive gear 80 to freely rotate (ratchet) in direction 100 relative to housing 14 and pawl 80 to enable repositioning of housing 14 and handle 30 in direction 110 without rotating drive gear 20.

FIG. 6B illustrates wrench 10 in a second, or loosening, position. To switch wrench 10 from the first (tightening)

position of FIG. 6A to the second (loosening) position of FIG. 6B, handle 30 is pivoted from the first position to the second position by rotating handle 30 about pivot axis 33 of pin 32 in a direction 110, which is opposite to direction 100 as illustrated in FIG. 6A, such that centerline 104 of wrench 10 is rotated in direction 110 from wrench centerline 104. As a result, pawl 80 moves from the "forward" position (as illustrated by FIG. 6A) to a "reverse" position, as illustrated by FIG. 6B, where tapered portion 83*b* is positioned within pawl guide region 94*b*. In one example, as illustrated, when moving between the forward and reverse positions, pawl 80 moves within pawl compartment 94 along an arcuate path substantially parallel to the circumference of drive gear 20. It is noted that as pawl 80 moves between the forward and reverse positions, linkage shaft 72 is pushed into internal shaft 64 and compresses linkage spring 76 as centerline 102 of handle 30 approaches wrench centerline 104 and is pushed outward from internal shaft 64 by linkage spring 76 as centerline 102 of handle 30 moves away from wrench centerline 104 to the second position.

After being switched to the second, or loosening, position, when rotational torque is applied to grip portion 34 of handle 30 in direction 110 (reverse direction), fulcrum portion 38 of handle 30 contacts portions of opposing sidewalls 96*a* and 96*b* of fulcrum compartment 96 (such as portions 97*c* and 97*d*) to rotate housing 14 and handle 30 about drive axis 21 in direction 110. As housing 14 is rotated in direction 110, with mounting stud 22 being held stationary, such as when engaged with a fastener, drive gear 80 attempts to rotate relative to housing 14 in direction 100 (i.e., opposite to direction 110).

However, as drive gear 20 attempts to rotate, pawl teeth 84*a* engage circumferential gear teeth 23 and tapered portion 83*b* is drawn and wedged into pawl guide region 94*b*, thereby preventing rotation of drive gear 80 relative to housing 14 in direction 100 (opposite to direction 110). As a result, drive gear 20, including mounting stud 22, are rotated together with housing 14 and handle 30, are rotated in direction 110 (reverse directions) about drive axis 21. When torque is applied to handle 30 about drive axis 21 in direction 100 (forward direction), pawl 80 allows drive gear 80 to freely rotate (ratchet) in direction 110 relative to housing 14 and pawl 80 to enable repositioning of housing 14 and handle 30 in direction 100 without rotating drive gear 20.

To return to the first, or tightening, position of FIG. 6A from the loosening position of FIG. 6B, handle 30 is rotated in direction 100 about the pivot axis 33 of pin 32. As described above, with pawl 80 captured or retained by handle 30 via linkage 70, pawl 80 cannot become disengaged from handle 30 during operation of wrench 10 even when large amounts of torque are applied to handle 30 to rotate housing 14, drive gear 20, and handle 30 about drive axis 21 in either forward direction 100 or reverse direction 110 (such as when tightening or loosening a fastener). As a result, pawl teeth 82 of pawl 80 will not become disengaged from drive teeth 23 of drive gear 20, which would otherwise render wrench 10 inoperable.

To switch handle 30 from the tightening to the loosening position (and vice-versa), an amount of torque applied to handle 30 must be large enough to overcome a resistance provided by spring 66 to move ridge 62 of fulcrum portion 38 from one side of apex 68 to the other.

Figure 7B:
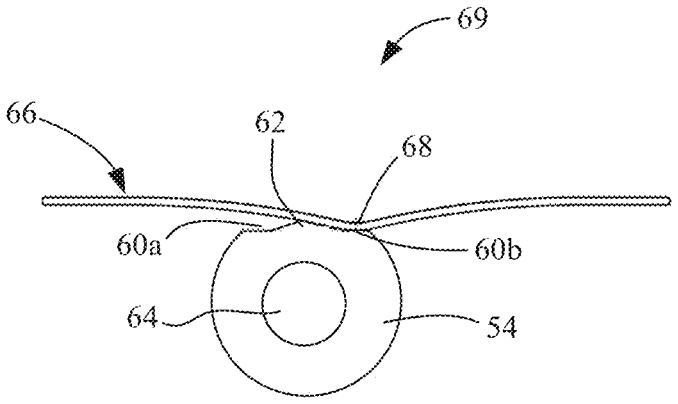
FIG. 7B is cross-sectional view illustrating position latch in a first position, according to one example.
Figure 7A:
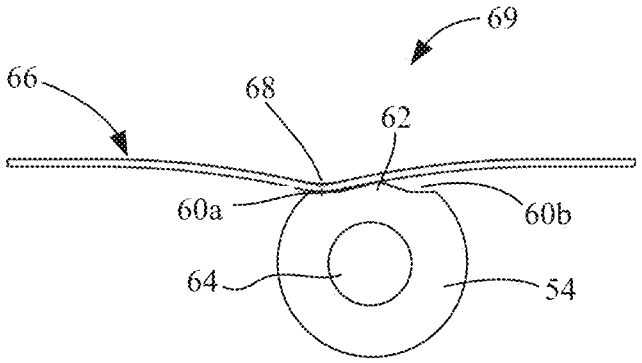
FIG. 7A is cross-sectional view illustrating position latch in a first position, according to one example.

FIGS. 7A and 7B are cross-sectional views generally illustrating portions of wrench 10 (looking from fulcrum portion 38 toward grip portion 34) and illustrating an operation of position latch 69, according to one example, where position latch 69 includes a ridge 62 and spring 66. In FIG. 7A, ridge 62 is shown on a first side of apex 68 of spring 66, which corresponds to the first or tightening position of handle 30 (also sometimes referred to as a forward position), as illustrated by FIG. 6A. In this position, a downward bias force, Fb, of spring 66 biases apex 68 against selector groove 60*a* and ridge 62, such that ridge 62 is unable to pass over apex 68, thus maintaining handle 30 in the first position.

To switch handle 30 from the first or tightening position (as illustrated by FIGS. 6A and 7A) to the second or loosening position (as illustrated by FIGS. 6B and 7B), sufficient torque must be applied to handle 30 about pin 32 (fulcrum axis 30) to overcome a resistance provided by spring 66 and apex 68 so that ridge 62 can "slide" or "snap" over apex 68 so as to pivot or toggle handle 30 from the first (tightening) position to the second (loosening) position. Once in the second or loosening position, apex 68 of spring 66 is biased against ridge 62 and selector groove 60*b* so that ridge 62 is unable to pass over apex 68 without sufficient torque being again applied about pin 32, thereby maintaining handle 30 in the second position.

Figure 8:
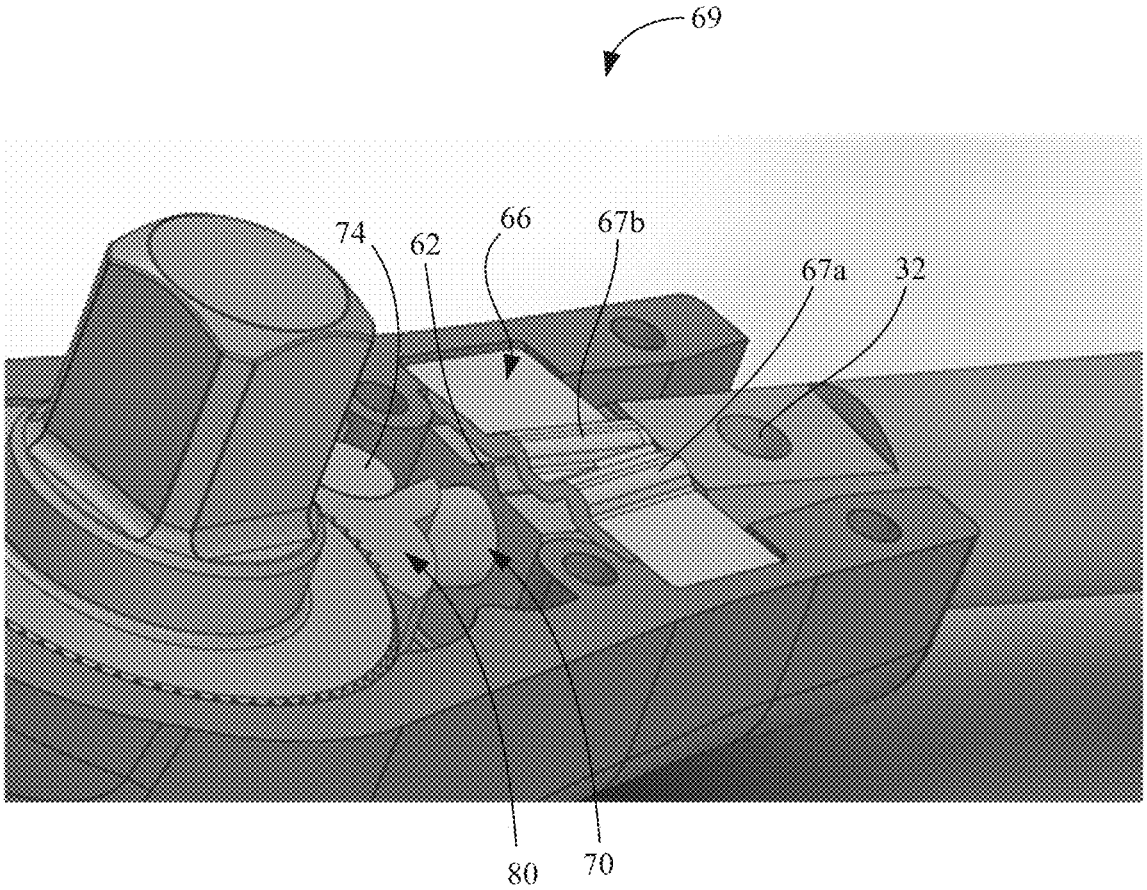
FIG. 8 is a perspective view illustrating a position latch, according to one example.

FIG. 8 is a perspective view of portions of head 12 and fulcrum portion 38 of handle 30 and illustrating another example of position latch 69. According to such example, in lieu of spring 66 having two arcuate portions that meet for form apex 68, spring 66 is a flat spring having two notches 67*a* and 67*b* which receive and maintain ridge 62 in a selected operating position of wrench 10, where notch 67*a* corresponds to the first or tightening position (see FIG. 6A) and notch 67*b* corresponds to the second or loosening position (see FIG. 6B). According to one example, as illustrated, a longitudinal dimension of each notch 67*a* and 67*b* aligns with the centerline 102 of handle 30 when handle 30 is in the corresponding position.

Although position latch 69 is illustrated as including spring 66 and ridge 62, it is noted that any number of other suitable position latching mechanisms may be employed to maintain handle 30 in a selected one of the first (tightening) and second (loosening) positions.

Figure 9:
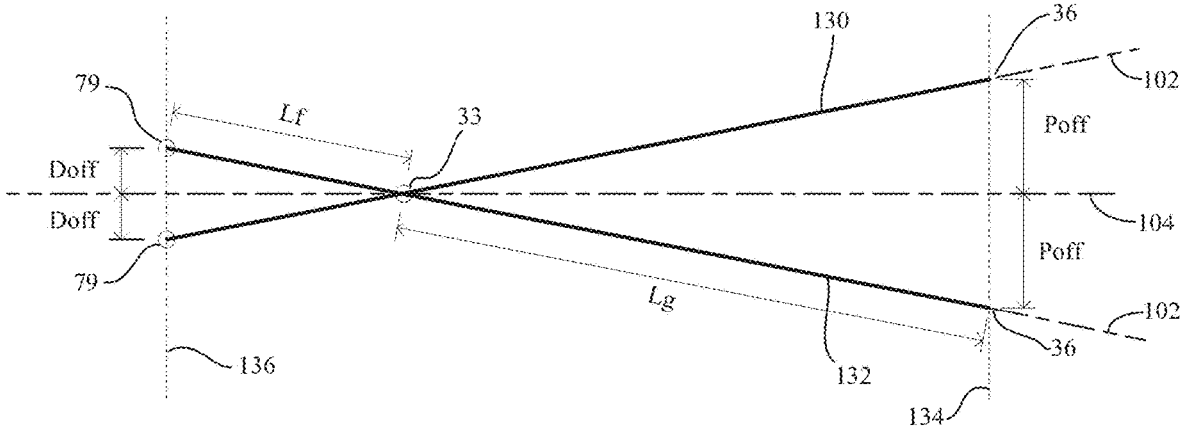
FIG. 9 is a schematic diagram generally illustrating operation of a rotating handle of a reversible ratchet, according to one example.

FIG. 9 is a schematic diagram illustrating an operation of handle 30 of wrench 10, according to one example. Heavy line 130 represents handle 30 when in a first position about pivot axis 33 (such as a forward or tightening position, as illustrated by FIG. 6A), while heavy line 132 represents handle 30 when in a second about pivot axis 33 (such as a reverse or loosening position, as illustrated by FIG. 6B). The centerline of handle 30 is illustrated at 102 and the centerline of wrench 10 is illustrated at 104. As illustrated, grip portion 34 of handle 30 from pivot axis 33 to proximal end 36 has a grip length, Lg, and fulcrum portion 38 of handle 30 from pivot axis 33 to distal axis 79 (e.g., the longitudinal axis of linkage head 74 of FIG. 2) has a fulcrum length, Lf. When in either position, proximal end 36 of handle 30 is at a proximal offset distance, Poff, from wrench centerline 104 along a line 134 perpendicular to centerline 104 of wrench 10, such that proximal end 36 moves a total distance of 2 x Poff when handle 30 is moved between the first position and the second position. Similarly, when handle 30 is the first position and the second position, distal axis 79 of handle 30 is at a distal offset distance, Doff, from centerline 104 along a line 136 perpendicular to centerline 104 of wrench 10, such that distal axis 79 (i.e., the axis of linkage head 74) moves a total distance of 2 x Doff when handle 30 is moved between the first position and the second position.

As described above, with known reversible wrenches, when operating a handle to change ratcheting directions, the proximal end of the handle may pivot over a relatively large distance such that the switching the ratcheting direction may be difficult in confined spaces.

In accordance with the present disclosure, the offset distance, Poff, is equal to the product of distal offset distance, Doff, and grip length, Lg, divided by the fulcrum length, Lf (i.e., Poff=(Doff×Lg)/Lf). Described in another way, according to the present disclosure, the fulcrum length, Lf, is equal to the product of the distal offset distance, Doff, and the grip length, Lg, divided by the proximal offset distance, Poff (i.e., Lf=(Doff×Lg)/Poff). As such, according to the present disclosure, for a wrench 10 having a given distal offset proximal, Doff (where Doff is generally greater the larger the wrench size; e.g.; ¼-inch wrench, ½-inch wrench, etc.), the longer the grip length, Lg, of handle 30 is made, the longer the fulcrum length, Lf, must be made to limit the proximal offset distance, Poff, of proximal end 36 of handle 30 to a desired distance during a switching operation to change ratcheting directions of wrench 10.

In one example, to limit the proximal offset distance, Poff, to 1-inch or less (such that the total travel distance of proximal end 36 when pivoting handle 30 to change the ratcheting direction of wrench 10 is not more than 2-inches), the fulcrum length, Lf, of handle 30 is at least equal to the product of the distal offset distance, Doff, and the grip length, Lg (i.e., Lf≥Doff×Lg). According to another example, to further limit the proximal offset distance, Poff, such as to ½-inch or less (such that the total travel distance of proximal end 36 when pivoting handle 30 to change the ratcheting direction of wrench 10 is not more than 1-inche), the fulcrum length, Lf, of handle 30 is at least equal to two times the product of the distal offset distance, Doff, and the grip length, Lg (i.e., Lf≥2×Doff×Lg).

Described differently, according to the present disclosure, the ratio of fulcrum length, Lf, to grip length, Lg, is equal to the ratio of the distal offset distance, Doff, to the proximal offset distance, Poff (i.e., (Lf/Lg)=(Doff/Poff)). As such, according to the present disclosure, for a given distal offset distance, to maintain the proximal offset distance, Poff, at a constant distance (e.g., ½-inch), the shorter the grip length, Lg, of handle 30, the longer the fulcrum, Lf, must be in order to maintain the fixed ratio between Doff and Poff. Stated in such terms, in one example, to limit the proximal offset distance, Poff, to 1-inch or less, a ratio of the fulcrum length, Lf, to the grip length, Lg, must not be less than the distal distance, Doff (i.e., Lf/Lg≥Doff). To further limit the proximal offset distance, Poff, such as to ½-inch or less, a ratio of the fulcrum length, Lf, to the grip length, Lg, must not be less than 2 times the distal distance, Doff (i.e., Lf/Lg≥2×Doff).

It is noted that an amount of movement of pawl 80 when switching between forward (tightening) and reverse (loosening) positions may vary depending on a size of the wrench. For example, an amount of pawl movement may be greater for a ½-inch wrench as compared to a ¼-inch wrench, meaning that the distal offset distance, Doff, may be greater for a ½-inch as compared to a ¼-inch wrench. In such case, according to the present disclosure, if a same grip length, Lg, is employed for both the ½-inch and the ¼-wrench, the fulcrum length, Lf, of the ½-inch wrench would need to be increased to maintain the proper ratio.

As an example, in view of the above, in a case where the distal offset distance, Doff, is 0.08 inches, and the grip length, Lg, of handle 30 is 7.31 inches, in order to maintain the proximal offset distance, Poff, at a distance not greater than 0.5 inches (such that a total travel distance of proximal end 36 is not greater than 1-inch during a switching operation), the fulcrum length, Lg, must not bet less than 1.17 inches (i.e., Lf≥2×Doff×Lg). Using the same example, in order to maintain the proximal offset distance, Poff, at a distance not great that 1 inch (such that a total travel distance of proximal end 36 is not greater than 2 inches during a switching operation), the fulcrum length, Lg, must not be less than −0.59 inches (i.e., Lf≥Doff×Lg).

In accordance with the present disclosure, while increasing the fulcrum length, Lf, to limit the proximal offset distance, Poff, may result in an increase in a length of housing 14 (as measured along wrench centerline 104), any potential drawback associated with such increased length are offset by the ability of wrench 10 to be easily switched between ratcheting directions via pivoting of handle 30 even when being used in confined spaces. An increase in fulcrum length, Lf, also reduces the potential for inadvertent switching between ratcheting directions since an amount of torque required to pivot handle 30 between the first and second positions increases the further ridge 62 and spring 66 are spaced from pivot axis 33. Additionally, with pawl 80 being retained by handle 30 (e.g., via hammer head pin 74 of linkage 70), and by applying torque from handle 30 to sidewalls of housing base 16 when applying torque to a fastener, pawl 80 is unable to become disengaged from handle 30 during operation of wrench 10.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A reversible ratchet wrench comprising:

a housing with a first end and a second end;

a drive gear disposed within and adjacent to the first end of the housing, the drive gear rotatable about a drive axis in a forward direction and a reverse direction and including a plurality of drive gear teeth disposed about a cylindrical surface of the drive gear;

a pawl disposed within the housing adjacent to the drive gear and between the drive gear and the second end, the pawl moveable along an arc paralleling the cylindrical surface of the drive gear between a first position corresponding to the forward direction and a second position corresponding to the reverse direction, the pawl having a body having:

a first side including a concave front surface facing the drive gear and having a plurality of teeth disposed thereon engageable with the drive gear teeth when the pawl is in the first and second positions; and an opposite second side having first and second ends and a cavity having a circular cross-section disposed between the first and second ends; and a handle including:

a first portion extending within the housing;

a linkage pivotally connecting the first portion of the handle to the pawl cavity; and a second portion extending from the second end of the housing, the first portion pivotally connected to the housing adjacent to second end of the housing with a fulcrum pin, the handle pivotable between a first position and a second position to move the pawl between the pawl first and second positions, where portions of the perimeter surface of the first portion of the handle on opposite sides of the fulcrum pin in the longitudinal dimension of the handle engage opposing inner sidewalls of the housing with the handle in the first and second positions so as to transfer torque from the handle to the housing and drive gear without applying forces to the fulcrum pin, linkage, and pawl.

2. The reversible ratchet wrench of claim 1, wherein the linkage is biased toward the pawl so as to bias the first side of the pawl against the drive gear.

3. The reversible ratchet wrench of claim 1, the linkage including:

a first linkage portion engaging the first portion of the handle; and a second linkage portion contained in the cavity.

4. The reversible ratchet wrench of claim 3, the cavity comprising a cylindrical opening extending at least partially through the pawl body and having a longitudinal axis in parallel with the drive axis, and the second portion of the linkage comprising a cylindrical pin disposed within the cylindrical opening.

5. The reversible ratchet wrench of claim 4, wherein an interior surface of the cylindrical opening encompasses greater than 180-degrees of an external surface of the cylindrical pin.

6. The reversible ratchet wrench of claim 4, wherein an interior surface of the cylindrical opening encompasses less than 180-degrees of an external surface of the cylindrical pin.

7. The reversible ratchet wrench of claim 3, wherein the cavity and first portion of the handle comprise a ball and socket type connection.

8. The reversible ratchet wrench of claim 3, wherein the first and second linkage portions have a common longitudinal axis, and where the first portion of the handle includes a bore at a free end of the first portion, the bore coaxial with the longitudinal axis, the first linkage portion position in the bore.

9. The reversible ratchet wrench of claim 8, further including a biasing means within the bore, the biasing means biasing the linkage and the pawl toward the drive gear.

10. A reversible ratchet wrench comprising:

a housing with a first end and a second end;

a drive gear disposed within and adjacent to the first end of the housing, the drive gear rotatable about a drive axis in a forward direction and a reverse direction and including a plurality of drive gear teeth disposed about a cylindrical surface of the drive gear;

a pawl disposed within the housing adjacent to the drive gear and between the drive gear and the second end, the pawl moveable along an arc paralleling the cylindrical surface of the drive gear between a tightening position to prevent rotation of the drive gear in the reverse direction and a loosening position, the pawl having a plurality of teeth to engage the drive gear teeth to respectively prevent rotation of the drive gear in the reverse and forward directions when in the tightening and loosening positions; and a handle longitudinally extending along a handle axis between a proximal end and a distal end, the handle pivotally connected to the housing adjacent to the second end via a fulcrum pin disposed between the proximal end and the distal end such that a distal portion of the handle extends within the housing, the handle to pivot about an axis of the fulcrum pin, the handle including:

a linkage extending from the distal end along the handle axis and including a linkage head to which the pawl is pivotally connected, the pawl to pivot about a longitudinal axis of the linkage head;

a wrench centerline extending perpendicularly through the fulcrum pin axis and the drive axis of the drive gear;

the handle to pivot about the fulcrum axis between a first position and second position relative to the wrench centerline to respectively move the pawl between the tightening position and the loosening position, the pawl to pivot about the linkage head axis when moving between the tightening and loosening positions, the tightening and loosening positions representing furthest positions of the pawl and linkage head on opposing sides of the wrench centerline;

a distance from the fulcrum pin axis to the linkage head axis along the handle axis with the handle in the first or second position, such that the pawl is in the loosening position or the tightening position, defining a fulcrum length;

a distance from the fulcrum pin axis to proximal end of the handle along the handle axis defining a grip length;

a distance along a line perpendicular to the wrench centerline from the wrench centerline to the linkage head axis with the pawl in the loosening position or the tightening position defining a distal offset distance;

where the fulcrum length is at least equal to a product of the grip length and a magnitude of the distal offset distance.

11. The reversible ratchet wrench of claim 10, wherein the linkage is biased toward the pawl so as to bias the plurality of teeth of the pawl against the drive gear.

12. The reversible ratchet wrench of claim 10, the linkage including:

a first linkage portion engaging the first portion of the handle; and a second linkage portion including the linkage head.

13. The reversible ratchet wrench of claim 12, the pawl including a cavity extending at least partially there through to receive the linkage head such that the longitudinal axis of the linkage head is in parallel with the drive axis.

14. The reversible ratchet wrench of claim 13, wherein the cavity comprises a cylindrical opening having an interior surface which encompasses greater than 180-degrees of an external surface of the linkage head.

15. The reversible ratchet wrench of claim 13, wherein the cavity comprises a cylindrical opening having an interior surface which encompasses less than 180-degrees of an external surface of the linkage head.

16. The reversible ratchet wrench of claim 12, wherein the cavity and head comprise a ball and socket type connection.

17. The reversible ratchet wrench of claim 12, wherein the linkage has longitudinal linkage axis, and where the distal end of the handle includes a bore coaxial with the handle axis, an end of the linkage opposite the linkage head positioned in the bore such that the longitudinal linkage axis is coaxial with the handle axis.

18. The reversible ratchet wrench of claim 17, further including a biasing means within the bore, the biasing means biasing the linkage and the pawl toward the drive gear.

19. The reversible ratchet wrench of claim 10, wherein a proximal end of the handle is square in cross-section to receive a driver extension.

* * * * *